US009390670B2

(12) United States Patent
Lee et al.

(10) Patent No.: US 9,390,670 B2
(45) Date of Patent: Jul. 12, 2016

(54) DISPLAY DEVICE AND DRIVING METHOD THEREOF

(71) Applicant: Samsung Display Co., Ltd, Yongin (KR)

(72) Inventors: Jong Jin Lee, Yongin-si (KR); Jin Kyu Park, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 56 days.

(21) Appl. No.: 14/304,580

(22) Filed: Jun. 13, 2014

(65) Prior Publication Data

US 2015/0206492 A1 Jul. 23, 2015

(30) Foreign Application Priority Data

Jan. 20, 2014 (KR) ..... 10-2014-0006910

(51) Int. Cl.

| | |
|---|---|
| ***G09G 5/00*** | (2006.01) |
| ***G09G 3/36*** | (2006.01) |
| *G09G 3/20* | (2006.01) |

(52) U.S. Cl.

CPC ..... *G09G 3/3648* (2013.01); *G09G 3/20* (2013.01); *G09G 2330/08* (2013.01); *G09G 2330/12* (2013.01); *G09G 2340/16* (2013.01)

(58) Field of Classification Search

CPC ..... G09G 3/3648
USPC ..... 345/208
See application file for complete search history.

(56) References Cited

U.S. PATENT DOCUMENTS

| | | | | |
|---|---|---|---|---|
| 6,867,759 | B1 | 3/2005 | Baek et al. | |
| 2007/0126686 | A1* | 6/2007 | Chang | G09G 3/3648 345/98 |
| 2009/0121997 | A1* | 5/2009 | Jo | G09G 3/20 345/99 |
| 2012/0194532 | A1 | 8/2012 | Shih et al. | |
| 2013/0127795 | A1 | 5/2013 | Hsu et al. | |
| 2013/0215090 | A1 | 8/2013 | Kim et al. | |
| 2013/0307421 | A1* | 11/2013 | Tanada | H05B 37/00 315/172 |
| 2013/0321644 | A1* | 12/2013 | Chung | G09G 3/006 348/184 |

FOREIGN PATENT DOCUMENTS

| | | |
|---|---|---|
| JP | 2010-078874 | 4/2010 |
| KR | 10-2009-0004014 | 1/2009 |
| KR | 10-0954327 | 4/2010 |

* cited by examiner

*Primary Examiner* — Jason Olson
(74) *Attorney, Agent, or Firm* — H.C. Park & Associates, PLC

(57) ABSTRACT

A display device including pixels; a data driver configured to apply a data signal to data lines connected to the pixels; and a signal controller configured to receive an image signal, a data enable signal, and a main clock signal, and to transmit an image data signal and an output signal that instructs transmitting of the data signal to the data driver. The signal controller is configured to detect electrostatic discharge (ESD) noise using the main clock signal and to mask the output signal when the image signal is distorted as a result of the ESD noise.

19 Claims, 8 Drawing Sheets

DISPLAY DEVICE AND DRIVING METHOD THEREOF

CROSS-REFERENCE TO RELATED APPLICATION

This application claims priority from and the benefit of Korean Patent Application No. 10-2014-0006910, filed on Jan. 20, 2014, which is hereby incorporated by reference for all purposes as if fully set forth herein.

BACKGROUND

1. Field

Exemplary embodiments of the present invention relate to a display device and a driving method thereof. More particularly, exemplary embodiments of the present invention relate to a display device that can minimize electrostatic discharge (ESD) noise, and a driving method thereof.

2. Discussion of the Background

A display device, such as a liquid crystal display, an organic light emitting diode display, and the like includes scan lines and data lines connected to pixels. The pixels are formed at crossing points of the scan lines and the data lines.

When a scan signal of a gate-on voltage is sequentially applied to the scan lines, a data signal is applied to the data lines corresponding to the scan signal of the gate-on voltage such that image data is written into the pixels.

Recently, a display device, including a touch screen panel, has tended to be slimmer, and the thickness of the display device has become thinner. Such a tendency makes the display device vulnerable to ESD. ESD is a factor that may cause damage to an integrated circuit (IC) and various other elements in the display device.

A failure caused by ESD can be classified as either a hard failure mode or a soft failure mode. When the hard failure mode occurs, the damaged IC cannot normally perform its function, even if the damaged IC is reset. When the soft failure mode occurs, the IC instantaneously enters an abnormal state due to ESD, but the IC can normally perform its function after being reset.

The failure caused by ESD also includes ESD noise occurring at the moment that a charged material contacts the display device, in addition to the hard failure mode and the soft failure mode. ESD noise affects input or output of the display device. As a result of ESD noise, data is distorted, and the distorted data may cause a horizontal line to be displayed on the screen. ESD noise may occur instantaneously, and unlike the soft failure mode, the ESD noise failure mode is typically only temporary in nature.

The above information disclosed in this Background section is only for enhancement of understanding of the background of the invention and, therefore, it may contain information that does not constitute prior art.

SUMMARY

Exemplary embodiments of the present invention provide a display device that can minimize ESD noise, and a method for driving the same.

Additional features of the invention will be set forth in the description which follows, and in part will be apparent from the description, or may be learned by practice of the invention.

An exemplary embodiment of the present invention discloses a display device including: pixels; a data driver configured to apply a data signal to data lines connected to the pixels; and a signal controller configured to receive an image signal, a data enable signal, and a main clock signal, and to transmit an image data signal and an output signal that instructs sending of the data signal to the data driver. The signal controller is configured to detect ESD noise using the main clock signal and to mask the output signal when the image signal is distorted as a result of the ESD noise.

An exemplary embodiment of the present invention also discloses a display device including: pixels; a data driver configured to apply a data signal to data lines connected to the pixels; and a signal controller configured to receive an image signal, a data enable signal, and a main clock signal, and to transmit an image data signal and an output signal that instructs output of the data signal to the data driver. The signal controller is configured to detect ESD noise using the main clock signal, and to generate the image data signal with an image signal of the previous frame instead of using an image signal when the image signal is distorted as a result of the ESD noise.

An exemplary embodiment of the present invention also discloses a method for driving a display device including pixels connected to signal lines and data lines arranged in a matrix, the method including: receiving an image signal and a main clock signal; detecting ESD noise by detecting waveform fluctuation of the main clock signal; and, when the image signal is distorted as a result of the ESD noise, generating a data signal to be applied to the data lines connected to the pixels which is the data signal corresponding to the pixels of the previous scan line.

An exemplary embodiment of the present invention also discloses a method for driving a display device including pixels connected to signal lines and data lines arranged in a matrix, the method including: receiving an image signal and a main clock signal; storing the image signal per frame unit; detecting ESD noise by detecting waveform fluctuation of the main clock signal; and, when the image signal is distorted as a result of the ESD noise, generating a data signal to be applied the data lines connected to the pixels, which is the data signal applied to the previous frame.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
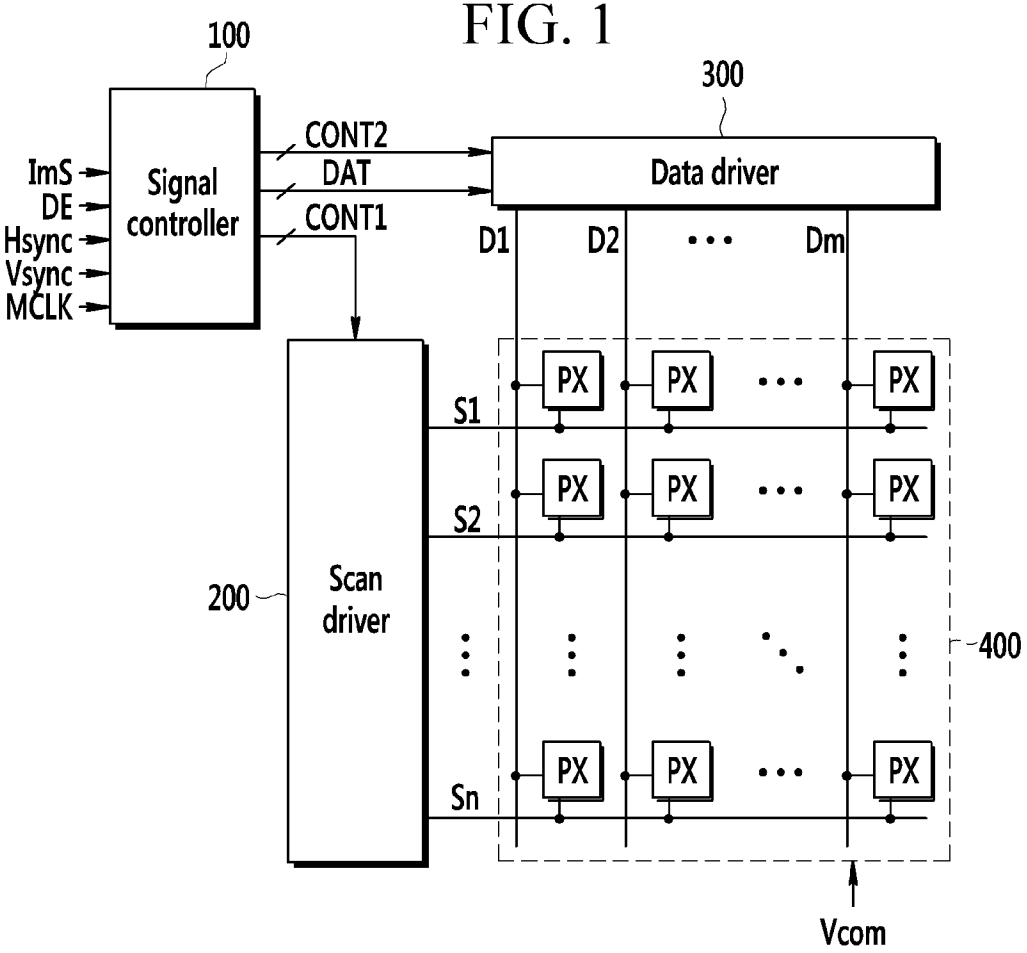
FIG. 1 is a block diagram of a display device according to an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of elements may be exaggerated for clarity. Like reference numerals in the drawings denote like elements.

Throughout this specification and the claims that follow, when it is described that an element is "coupled" to another element, the element may be "directly coupled" to the other element or "electrically coupled" to the other element through a third element. It will be understood that for the purposes of this disclosure, "at least one of X, Y, and Z" can be construed as X only, Y only, Z only, or any combination of two or more items X, Y, and Z (e.g., XYZ, XYY, YZ, ZZ). In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an exemplary embodiment of the present invention.

Referring to FIG. 1, the display device includes a signal controller 100, a scan driver 200, a data driver 300, and a display unit 400.

The display unit 400 includes scan lines S1 to Sn, data lines D1 to Dm, and pixels PX. The pixels PX are connected to the signal lines S to Sn and D1 to Dm, and arranged substantially in a matrix format. The scan lines S1 to Sn are extended substantially in a row direction and substantially parallel with each other. The data lines D1 to Dm are extended in a column direction and substantially parallel with each other.

The display unit 400 may be liquid crystal panel assembly, and the liquid crystal panel assembly includes a thin film transistor display panel 10 (refer to FIG. 2), a common electrode display panel 20 (refer to FIG. 2), and a liquid crystal layer 15 (refer to FIG. 2) filled between the two display panels 10 and 20. At least one polarizer (not shown) for polarizing light may be attached to an outer surface of the display unit 400.

The display device may, for example, be a liquid crystal display including a liquid crystal display panel assembly. Other examples of the display device may include an organic light emitting diode display, a field emission display (FED), a plasma display (PDP), and the like.

The signal controller 100 receives an image signal ImS and an input control signal controlling display of the image signal ImS. The image signal ImS contains luminance information about the plurality of pixels. The luminance has a preset number, for example, $1024=2^{10}$, $256=2^{8}$, or $64=2^{6}$, of gray levels. The input control signals include a data enable signal DE, a horizontal synchronization signal Hsync, a vertical synchronization signal Vsync, and a main clock signal MCLK.

The signal controller 100 transmits the image data signal DAT and the data control signal CONT2 to the data driver 300. The data control signal CONT2 controls the operation of the data driver 300, and includes a horizontal synchronization start signal informing transmission start of an image data signal DAT, an output signal TP instructing output of a data signal data to the data lines D1 to Dm, and a data clock signal HCLK. The data control signal CONT2 may further include an inverse signal RVS that inverts voltage polarity of the image data signal DAT with respect to the common voltage Vcom.

The signal controller 100 transmits the scan control signal CONT1 to the scan driver 200. The scan control signal CONT1 controls operation of the scan driver 200, and may include a scan start signal STV in the scan driver 200 and at least one clock signal CKV controlling output of a gate-on voltage. The scan control signal CONT1 may further include an output enable signal OE that limits duration of the gate-on voltage.

The signal controller 100 detects ESD noise by detecting waveform fluctuation of the main clock signal MCLK, and can prevent output of an abnormal data signal data resulting from an image signal ImS that is distorted as a result of ESD noise. ESD noise is noise generated at the moment that a charged material contacts the display device, and may affect input or output of the display device. When the ESD noise signal is detected, the signal controller 100 can prevent an abnormal data signal data from being output by using at least one of a method that masks the output signal TP and a method that generates the image data signal DAT with an image signal ImS of the previous frame instead of using the distorted image signal ImS.

The data driver 300 is connected to the data lines D1 to Dm arranged in the display unit 400, and selects a gray voltage corresponding to the image data signal DAT. The data driver 300 applies the selected gray voltage as a data signal data to the data lines D1 to Dm. The data driver 300 generates the gray voltage with respect to an entire grayscale by dividing reference gray voltages of a preselected number. The data driver 30 may select the gray voltage corresponding to the image data signal DAT from among them.

The scan driver 200 is connected to scan lines S1 to Sn disposed at the display unit 400, and applies the scan signal configured by combining the gate-on voltage that turns on a switching element (see Q of FIG. 2) and a gate-off voltage that turns it off to the scan lines S1 to Sn. The scan driver 200 may sequentially apply the scan signal of the gate-on voltage to the scanning lines S1 to Sn.

Each of the signal controller 100, scan driver 200, and data driver 300 may be directly mounted on the display unit 400 in the form of at least one IC chip, mounted on a flexible printed circuit (FPC) film to be attached to the display unit 400 in the form of a tape carrier package (TCP), or mounted on a separate printed circuit board (PCB). Alternatively, the signal controller 100, scan driver 200, and data driver 300 may be integrated in the display unit 400 with the scanning lines S1 to Sn and the data lines D1 to Dm.

For example, an operation of the scan driver 200 may be provided to the display unit 400 by an amorphous silicon gate (ASG). In addition, the data driver 300 may be provided as a driving IC in which an operation of the signal controller 100 is included.

Figure 2:
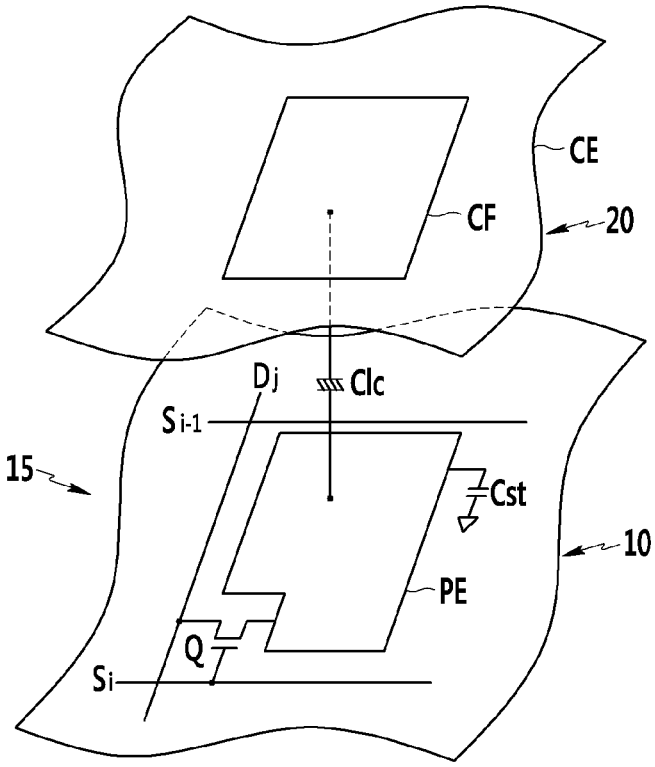
FIG. 2 is an equivalent circuit diagram of one pixel of the display device according to an exemplary embodiment of the present invention.

FIG. 2 is an equivalent circuit diagram of one pixel of the display device according to an exemplary embodiment of the present invention.

Referring to FIG. 2, one pixel PX of the display unit 400 will be described. A pixel PX connected to an i-th scan line S1 and a j-th data line Dj will be illustrated ($1<i\leq n$, $1\leq j\leq m$) as an example. The pixel PX includes a switching element Q, a liquid crystal capacitor Clc connected to the switching element Q, and a storage capacitor Cst.

The switching element Q is a three-terminal element, such as a thin film transistor provided in the thin film transistor array panel 10. The switching element Q includes a gate terminal connected to the scanning lines S1 to Sn, an input terminal connected to the data lines D1 to Dm, and an output terminal connected to the storage capacitor Cst. The thin film transistor includes amorphous silicon or polysilicon.

The thin film transistor may be an oxide thin film transistor of which a semiconductor layer is made of an oxide semiconductor. The oxide semiconductor may include one of an oxide based on titanium (Ti), hafnium (Hf), zirconium (Zr), aluminum (Al), tantalum (Ta), germanium (Ge), zinc (Zn), gallium (Ga), tin (Sn), or indium (In), and complex oxides thereof, such as zinc oxide (ZnO), indium-gallium-zinc oxide ($InGaZnO_4$), indium zinc oxide (In—Zn—O), zinc-tin oxide (Zn—Sn—O), indium gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium—aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium—germanium gallium oxide (In—Ge—Ga—O), titanium-indium-zinc oxide (Ti—In—Zn—O), and hafnium—indium-zinc oxide (Hf—In—Zn—O).

The semiconductor layer includes a channel area in which impurities are not doped, and a source area and a drain area, in which impurities are doped, arranged at respective sides of the channel area. The impurities may vary according to the type of thin film transistor utilized, and may be N-type impurities or P-type impurities.

When the semiconductor layer is formed of the oxide semiconductor, a separate passivation layer may be added in order to protect the oxide semiconductor, which is vulnerable to the external environment and high temperatures.

The liquid crystal capacitor Clc includes a pixel electrode PE of the thin film transistor array panel 10 and a common electrode C of the common electrode panel 20 as two terminals, and the liquid crystal layer 15 functions as a dielectric material between the pixel electrode PE and the common electrode CE. The liquid crystal layer 15 has dielectric anisotropy.

The pixel electrode PE is connected to the switching element Q, and the common electrode CE is formed by the entire surface of the common electrode panel 20 and receives the common voltage Vcom. Unlike what is shown in FIG. 2, the common electrode CE may be provided in the thin film transistor array panel 10, and in this case, at least one of the two electrodes PE and CE may be formed in the shape of a line or a bar.

The storage capacitor Cst, which plays an auxiliary role for the liquid crystal capacitor Clc, is formed when a separate signal line (not illustrated) provided on the lower panel 100 and the pixel electrode 191 are overlapped with each other with an insulator therebetween, and a voltage, such as a common voltage Vcom, is applied to the separate signal line.

A color filter CF may be formed in a part of the common electrode CE of the common electrode panel 20. Each pixel PX may be set to uniquely display one of primary colors, and thus, a desired color may be recognized by the spatial sum of the primary colors. Each of the pixels PX alternately displays one of the primary colors according to time such that a desired color can be recognized by the temporal sum of the primary colors. Examples of the primary colors may include three primary colors such as red, green, and blue.

As an example of the spatial division, each pixel PX is provided with a color filter CF that represents one of the primary color in an area of the common electrode display panel 20 corresponding to the pixel electrode PE. However, the color filter may be provided above or below the pixel electrode PE of the thin film transistor array panel 10.

Figure 3:
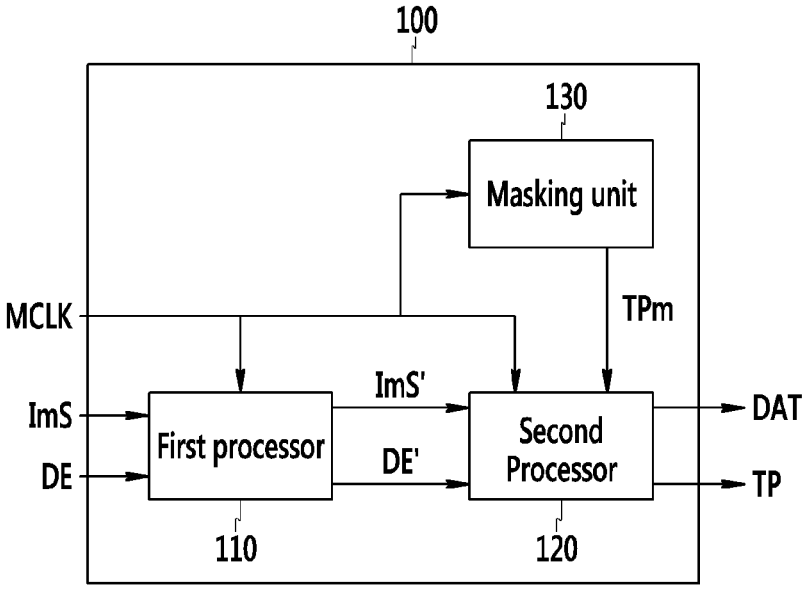
FIG. 3 is a block diagram of a signal controller according to an exemplary embodiment of the present invention.

FIG. 3 is a block diagram of the signal controller according to the exemplary embodiment of the present invention. In FIG. 3, necessary constituent elements for minimization of an influence of the ESD noise are illustrated, and other constituent elements are omitted.

Referring to FIG. 3, the signal controller 100 includes a first processor 110, a second processor 120, and a masking unit 130.

The first processor 110 receives an image signal ImS, a data enable signal DE, and a main clock signal MCLK. The first processor 110 filters an ESD noise in the image signal ImS and the data enable signal DE. That is, although the ESD noise is included in the data enable signal DE, the first processor 110 recovers the data enable signal DE to its original level by a preselected number of clock signals (i.e., the number of clock signals of the main clock signal MCLK) to generate a filtered data enable signal DE' that does not include the ESD noise. In addition, the first processor 110 eliminates a portion, including the ESD noise, of the image signal ImS, and generates a filtered image signal ImS' with a portion that does not include the ESD noise. The first processor 110 outputs the filtered image signal ImS' in synchronization with the filtered data enable signal DE'.

The second processor 120 receives the filtered image signal ImS', the filtered data enable signal DE', and the main clock signal MCLK. The second processor 120 generates the image data signal DAT by converting the filtered image signal ImS' into a format that can be output from the data driver 300. In addition, the second processor 120 generates an output signal TP that instructs the data signal data from the data driver 300 corresponding to the image data signal DAT. The output signal TP can be generated using the filtered data enable signal DE'. For example, the output signal TP may be output with a gate-on voltage when the filtered data enable signal DE' is output with a gate-off voltage (that is, a low-level voltage) while the filtered data enable signal DE' is output as a gate-on voltage (that is, a high-level voltage).

The masking unit 130 receives the main clock signal MCLK. The masking unit 130 may detect the ESD noise by detecting waveform fluctuations of the main clock signal MCLK. That is, when the main clock signal MCLK is received with an abnormal waveform resulting from the ESD noise, the masking unit 130 can detect occurrence of the ESD noise. When the ESD noise is detected, the masking unit 130 generates a TP masking signal TPm and transmits the generated signal to the second processor 120. The TP masking signal TPm is a signal masking the output signal TP. In more detail, the TP masking signal TPm is a signal masking the output signal TP that instructs output of a data signal data corresponding to an image signal ImS received at the time of occurrence of the ESD noise. When the output signal TP that instructs output of the data signal data corresponding to the image signal ImS received at the occurrence time of the ESD noise is masked, previously output data signal data is continuously output from the data driver 300. Accordingly, an abnormal data signal abnormal resulting from the ESD noise is not output to the data lines D1 to Dm.

Hereinafter, operation for minimizing the ESD noise in the signal controller 100 will be described with reference to FIG. 4 to FIG. 6.

Figure 4:
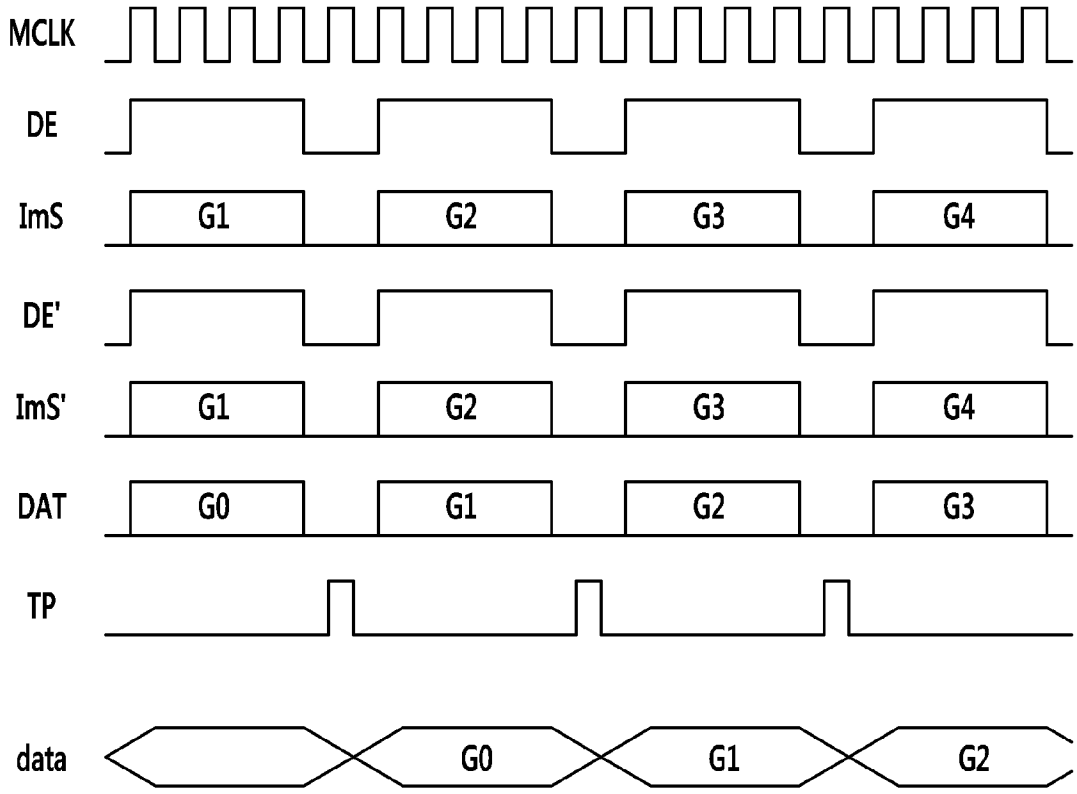
FIG. 4 is a timing diagram of an input and output signal of the signal controller and a data signal of a data driver according to an exemplary embodiment of the present invention.

FIG. 4 is a timing diagram illustrating an input/output signal of the signal controller and a data signal of the data driver according to an exemplary embodiment of the present invention. FIG. 4 shows a case in which no ESD noise is generated.

In FIG. 4, the main clock signal MCLK and the data enable signal DE are input to the first processor 110 with a preselected period. The period of the data enable signal DE may be equivalent to 1 horizontal period 1H. The 1 horizontal period may be the same as a period of the horizontal synchronizing signal Hsync.

The image signal ImS may be sequentially input to the scan lines S1 to Sn in accordance with the period of the data enable signal DE. For example, G1, G2, G3, and G4 of the image signal ImS may be sequentially input in accordance with the period of the data enable signal DE. Each of G1, G2, G3, and G4 may be an image signal ImS corresponding to pixels arranged in one scan line.

Because no ESD noise is generated, the data enable signal DE and the image signal ImS are directly output as a filtered data enable signal DE' and a filtered image signal ImS'. The filtered image signal ImS' is processed in the second processor 120, and thus, output as the image data signal DAT after 1 horizontal period 1H.

The output signal TP is output for every 1 horizontal period 1H. After receiving the image data signal DAT corresponding to one scan line, the data driver 300 outputs a data signal data corresponding to an input output signal TP. Thus, the data signal data can be output after being delayed by 1 horizontal period 1H after generation of the image data signal DAT corresponding to the data signal data.

Figure 5:
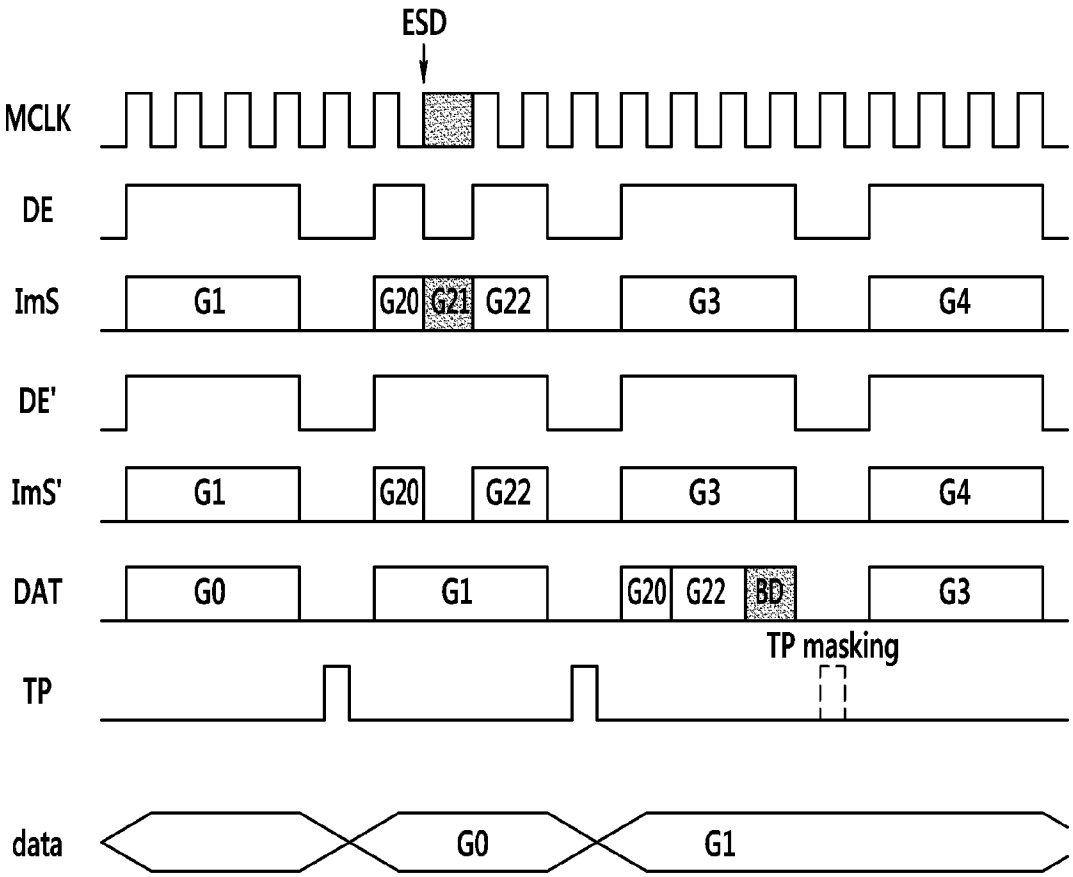
FIG. 5 is a timing diagram illustrating operation for minimizing ESD noise in the signal controller according to an exemplary embodiment of the present invention.

FIG. 5 is a timing diagram illustrating operation for minimization of the ESD noise in the signal controller according to an exemplary embodiment of the present invention. FIG. 5 shows a case in which the ESD noise occurs. FIG. 6 is a timing diagram for description of a horizontal line failure that occurs in the case where the ESD noise is not eliminated.

Referring to FIG. 5, ESD noise is assumed to occur at the time that the image signal ImS of G2 is input.

When ESD noise occurs, the main clock signal MCLK, the data enable signal DE, and the image signal ImS are instantaneously abnormally fluctuated or stopped altogether. The ESD noise of the data enable signal DE is eliminated through the first processor 110, and the filtered data enable signal DE' can be recovered to a normal signal.

However, the main clock signal MCLK and the image signal ImS are not recovered in the form of normal signals. In particular, a portion including the ESD noise in the image signal ImS is eliminated, and a portion that does not include the ESD noise becomes the filtered image signal ImS'. For example, among G20, G21, and G22 included in the image signal ImS of G2, G21, which includes the ESD noise, is eliminated. Thus, only G20 and G22 are included in the filtered image signal ImS'.

The filtered image signal ImS' including only G20 and G22 is processed in the second processor 120. Thus, an image data signal DAT is generated, and blank data BD is filled in the image data signal DAT instead of the eliminated G21.

Figure 6:
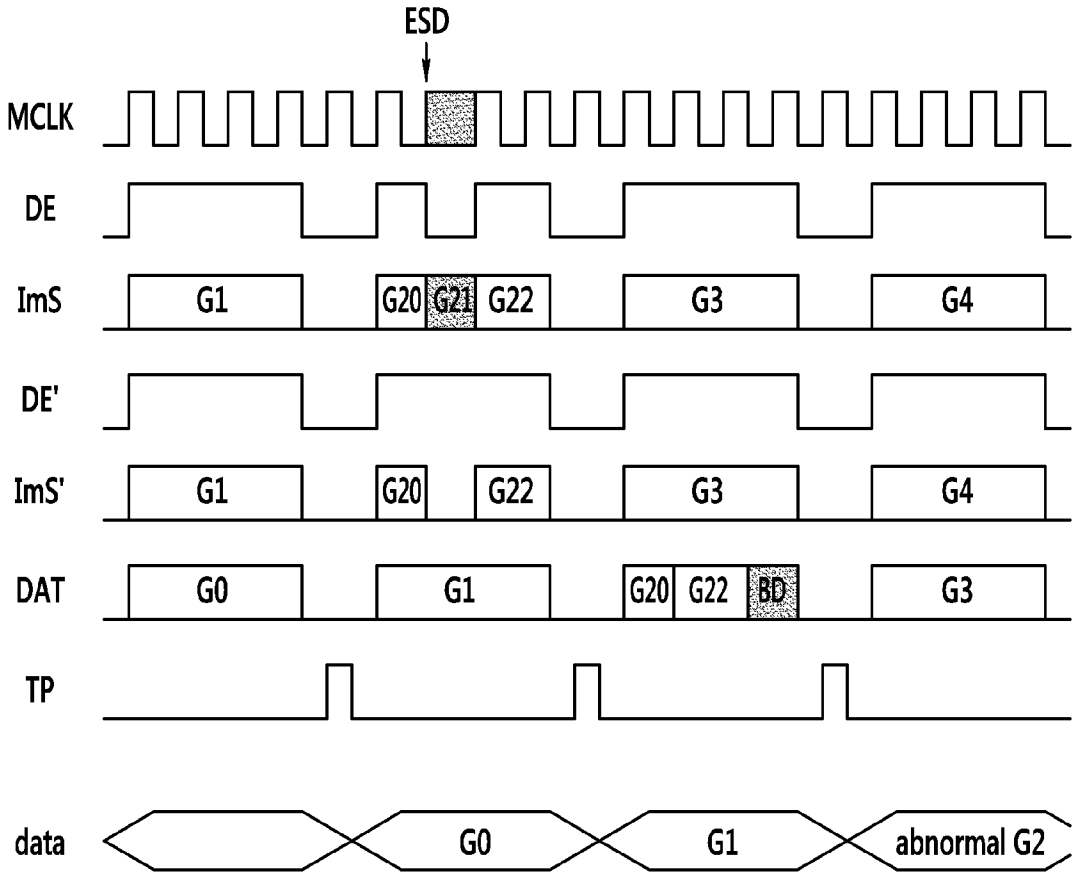
FIG. 6 is a timing diagram illustrating a horizontal line failure occurring as a result of ESD noise not being eliminated.

If, as shown in FIG. 6, the image data signal DAT including the blank data BD and the output signal TP are transmitted to the data driver 300, the data driver 300 outputs the abnormal data signal abnormal G2 corresponding to the image data signal DAT that includes the blank data BD to the data lines D1 to Dm. As a result of the abnormal data signal abnormal G2, a failure occurs, and thus, a horizontal line is displayed in the screen.

Referring back to FIG. 5, when the masking unit 120 detects a portion received with an abnormal waveform in the main clock signal MCLK, the masking unit 120 generates the TP masking signal TPm, and transmits the generated signal to the second processor 120. Then, the second processor 120 masks the output signal TP that instructs output of a data signal data that corresponds to the image data signal DAT that includes the blank data BD. As the output signal TP is masked, the data driver 300 continuously outputs the data signal data corresponding to G1 until the data signal data corresponding to the image data signal DAT where the blank data BD is included is expected to be output. Accordingly, the abnormal data signal abnormal G2 due to the ESD noise is not output to the data lines D1 to Dm.

Because pixels of adjacent scan lines S1 to Sn in one frame of a general image emit light with similar luminance, the failure that causes displaying of a horizontal line in the screen can be prevented by inputting a data signal corresponding to a pixel of the previous scan line (e.g., a data signal corresponding to G1) as a data signal corresponding to the next scan line (e.g., a data signal corresponding to G2).

Figure 7:
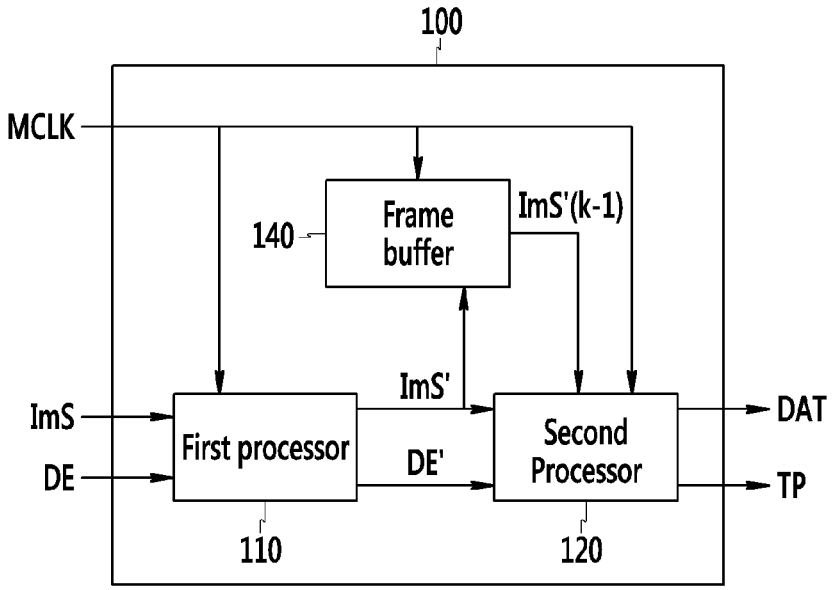
FIG. 7 is a block diagram of a signal controller according to an exemplary embodiment of the present invention.

FIG. 7 is a block diagram of a signal controller according to another exemplary embodiment of the present invention.

Referring to FIG. 7, a signal controller 100 includes a first processor 110, a second processor 120, and a frame buffer 140. The first processor 110 and the second processor 120 are the same as those of FIG. 3, and therefore no further description will be provided.

The frame buffer 140 receives a main clock signal MCLK and a filtered image signal ImS'. The frame buffer 140 can detect ESD noise by detecting waveform fluctuations of the main clock signal MCLK.

The frame buffer 140 stores the filtered image signal ImS' per frame unit. In more detail, the frame buffer 140 stores a filtered image signal ImS'(k−1) of the previous frame, and a sequentially input filtered image signal ImS' of the present frame may be sequentially uploaded to the frame buffer 140.

When ESD noise is detected, the frame buffer 140 transmits the filtered image signal ImS'(k−1) of the previous frame, stored therein, to the second processor 120. In more detail, when the ESD noise is detected while sequentially receiving the filtered image signal ImS' of the present frame, a filtered image signal ImS' is not uploaded during the detection time of the ESD noise, and the frame buffer 140 transmits a portion in the filtered image signal ImS'(k−1) of the previous frame, which needs to be uploaded as a filtered image signal ImS' of the present frame, to the second processor 120.

When generating the image data signal DAT, the second processor 120 includes the filtered image signal ImS'(k−1) of the previous frame transmitted from the frame buffer 140 in the image data signal DAT by priority. Thus, an image signal ImS received at the occurrence time of the ESD noise is not included in the image data signal DAT, and an abnormal data signal abnormal data resulting from ESD noise is not output to the data lines D1 to Dm.

Figure 8:
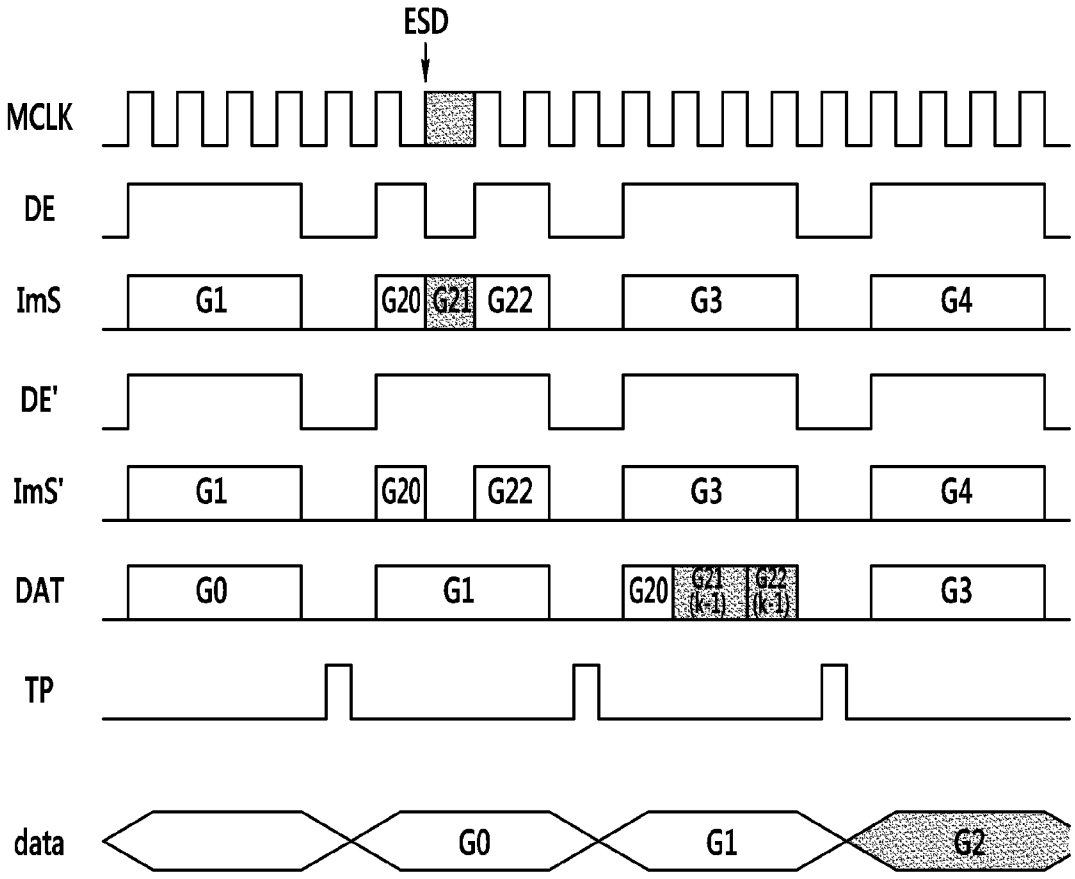
FIG. 8 is a timing diagram illustrating an operation for minimizing ESD noise in the signal controller according to an exemplary embodiment of the present invention.

FIG. 8 is a timing diagram of operation for minimization of an ESD noise in a signal controller according to another exemplary embodiment of the present invention. FIG. 7 illustrates a method for minimizing ESD noise using the signal controller of FIG. 7.

Referring to FIG. 8, it is assumed that the ESD noise is generated at the input time of the image signal ImS of G2.

When ESD noise occurs, the main clock signal MCLK, the data enable signal DE, and the image signal ImS are instantaneously abnormally fluctuated or stopped altogether. The first processor 110 eliminates the ESD noise of the data enable signal DE, and a filtered data enable signal DE can be recovered to a normal signal.

However, the main clock signal MCLK and the image signal ImS cannot be recovered to normal signals. In particular, a portion including the ESD noise in the image signal ImS is eliminated, and a portion that does not include the ESD noise becomes the filtered image signal ImS'. For example, among G20, G21, and G22 included in the G2 image signal ImS, G21, including the ESD noise, is eliminated. Thus, only G20 and G22 are included in the filtered image signal ImS'.

When ESD noise is detected, the frame buffer 140 transmits a filtered image signal ImS'(k−1) of the previous frame to the second processor 120. In this case, the filtered image signal ImS'(k−1) of the previous frame can include only a portion after the detection time of the ESD noise. For example, with respect to G21 including the ESD noise, a filtered image signal ImS'(k−1) of G21($k$−1) and G22($k$−1) of the previous frame can be transmitted to the second processor 120.

The image data signal DAT can be generated by combining of the filtered image signal ImS' of the present frame, in which the ESD noise is not included, and the filtered image signal ImS'(k−1) of the previous frame. For example, the image data signal DAT can be generated with G20 of the present frame and G21($k$−1) and G22($k$−1) of the previous frame. The data driver 300 outputs a data signal corresponding to the image data signal DAT that is generated by combination of G20 of the present frame and G21($k$−1) and G22($k$−1) of the previous frame. Accordingly, an abnormal data signal resulting from the ESD noise is not output.

Because pixels of the same scan lines S1 to Sn between sequential frames of a general image emit light with similar luminance, a failure that causes displaying of a horizontal line in the screen can be prevented even though a data signal of the previous frame (e.g., a data signal corresponding to G21($k$−1) and G22($k$−1)) is input as a data signal of the next frame (e.g., a data signal corresponding to G21 and G22).

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A display device comprising:

pixels connected to signal lines and data lines arranged in a matrix;

a data driver configured to apply a data signal to the data lines; and a signal controller configured to receive an image signal, a data enable signal, and a main clock signal, and to transmit an image data signal and an output signal that instructs sending of the data signal to the data driver, wherein:

the signal controller comprises a masking unit configured to detect electrostatic discharge (ESD) noise by detecting waveform fluctuation of the main clock signal; and the signal controller is configured to mask the output signal when the image signal is distorted as a result of the ESD noise.

2. The display device of claim 1, wherein:

the signal controller further comprises:

a first processor configured to receive the image signal, the data enable signal, and the main clock signal, and to filter the ESD noise from the image signal and the data enable signal to generate a filtered image signal and a filtered data enable signal; and a second processor configured to generate the image data signal by converting the filtered image signal; and the masking unit is configured to generate a masking signal that masks the output signal when the ESD noise is detected.

3. The display device of claim 2, wherein the first processor is configured to recover the data enable signal to its original level by using a number of clock signals of the main clock signal, the ESD noise being included in the data enable signal, to generate the filtered data enable signal.

4. The display device of claim 3, wherein the first processor is configured to eliminate a portion in the image signal, which comprises the ESD noise, to generate the filtered image signal omitting the ESD noise.

5. The display device of claim 4, wherein the first processor is configured to output the filtered image signal while being synchronized with the filtered data enable signal.

6. The display device of claim 2, wherein the second processor is configured to generate the output signal as a gate-on voltage when the filtered data enable signal is output as a gate-off voltage.

7. The display device of claim 6, wherein the masking unit is configured to transmit the masking signal to the second processor.

8. The display device of claim 7, wherein the masking signal masks the output signal that instructs output of a data signal corresponding to an image signal received at the time that the ESD noise occurs.

9. A display device comprising:

pixels connected to signal lines and data lines arranged in a matrix;

a data driver configured to apply a data signal to the data lines; and a signal controller configured to receive an image signal, a data enable signal, and a main clock signal, and to transmit an image data signal and an output signal that instructs output of the data signal to the data driver, wherein:

the signal controller comprises a frame buffer configured to detect electrostatic (ESD) noise by detecting waveform fluctuation of the main clock signal; and the signal controller is configured to generate the image data signal using the image signal of the previous frame when the ESD noise is detected.

10. The display device of claim 9, wherein:

the signal controller further comprises:

a first processor configured to receive the image signal, the data enable signal, and the main clock signal, and to filter the ESD noise from the image signal and the data enable signal to generate a filtered image signal and a filtered data enable signal; and a second processor configured to generate the image data signal by converting the filtered image signal; and the frame buffer is configured to store the filtered image signal per frame unit, and to transmit a filtered image signal of a previous frame to the second processor when the ESD noise is detected.

11. The display device of claim 10, wherein the first processor is configured to generate the filtered data enable signal by recovering the data enable signal to its original level by using a number of clock signals of the main clock signal, the ESD noise being included in the data enable signal.

12. The display device of claim 11, wherein the first processor is configured to eliminate a portion in the image signal, which comprises the ESD noise, and to generate the filtered image signal by omitting the ESD noise.

13. The display device of claim 12, wherein the first processor is configured to output the filtered image signal while being synchronized with the filtered data enable signal.

14. The display device of claim 10, wherein the second processor is configured to generate the output signal as a gate-on voltage when the filtered data enable signal is output as a gate-off voltage.

15. The display device of claim 10, wherein the frame buffer is configured to sequentially receive filtered image signals of the present frame and to upload the received signals, and when the ESD noise is detected, the frame buffer is configured to not upload a filtered image signal of the present frame.

16. The display device of claim 15, wherein the frame buffer is configured to transmit a portion of the present frame, which needs to be uploaded as a filtered image signal, from a filtered image signal of the previous frame during detection time of the ESD noise.

17. The display device of claim 16, wherein the second processor is configured to comprise a filtered image signal of the previous frame.

18. A method for driving a display device including comprising pixels connected to signal lines and data lines arranged in a matrix, comprising:

receiving an image signal and a main clock signal;

detecting electrostatic discharge (ESD) noise by detecting waveform fluctuation of the main clock signal; and when the image signal is distorted as a result of the ESD noise, generating a data signal to be applied to the data lines connected to the pixels which is the same as the data signal corresponding to the pixels of the previous scan line.

19. A method for driving a display device comprising pixels connected to signal lines and data lines arranged in a matrix, comprising:

receiving an image signal and a main clock signal;

storing the image signal per frame unit;

detecting electrostatic discharge (ESD) noise by detecting waveform fluctuation of the main clock signal; and when the image signal is distorted as a result of the ESD noise, generating a data signal to be applied the data lines connected to the pixels, which is the same as the data signal applied to the previous frame.

* * * * *